United States Patent [19]

Ott et al.

[11] 4,112,604

[45] Sep. 12, 1978

[54] DISPLAY PANEL ASSEMBLY

[75] Inventors: Robert B. Ott, Cincinnati, Ohio; Lawrence R. Heringer, Edgewood, Ky.

[73] Assignee: The Hennegan Company, Cincinnati, Ohio

[21] Appl. No.: 754,423

[22] Filed: Dec. 27, 1976

[51] Int. Cl.[2] ..... G09F 15/00

[52] U.S. Cl. ..... 40/610; 40/605

[58] Field of Search ..... 40/125 H, 125 F, 126 A, 40/610, 611, 605; 248/165, 174, 459; 211/189, 195, 204, 206; 229/34 HW; 206/491

[56] References Cited

U.S. PATENT DOCUMENTS

| | | | |
|---|---|---|---|
| 2,085,097 | 6/1937 | Hansen | 40/125 |
| 3,250,455 | 5/1966 | Plunkett | 229/34 |
| 3,383,028 | 5/1968 | Brander | 229/16 |
| 3,426,913 | 2/1966 | Abatiell | 211/177 |
| 3,537,200 | 11/1970 | Bubb | 40/125 |
| 3,659,365 | 5/1972 | Eaton | 40/16 |

FOREIGN PATENT DOCUMENTS

| | | | |
|---|---|---|---|
| 2,504,686 | 8/1976 | Fed. Rep. of Germany | 40/125 |

*Primary Examiner*—John F. Pitrelli

*Assistant Examiner*—G. Lee Skillington

*Attorney, Agent, or Firm*—Wood, Herron & Evans

[57] ABSTRACT

An improved display panel assembly including a hollow three-dimensional display panel movable between a substantially flat storage attitude and an erect display attitude. A tubular support member extends along and is adjacent to one edge of the display panel, the tubular support member supporting the display panel in the erect attitude when that member is erected and permitting the display panel to collapse into the storage attitude when that member is collapsed. Slot and tab structure partially carried by the tubular support member and partially carried by a face wall of the display panel retains the tubular support member and, hence, the display panel itself, in the erect attitude. The hollow tubular member is structured so that, when the display panel is erected, the tubular member at least partially defines a passageway adapted to receive one end of a connector strip in supportive relation therein. The other end of the connector strip may be provided with a foot by which the display panel can be supported on a surface, or may be provided with another end, analogous to the one end, which permits the display panel to be connected with a similarly structured second display panel.

8 Claims, 7 Drawing Figures

DISPLAY PANEL ASSEMBLY

This invention relates to display panel assemblies. More particularly, this invention relates to an improved display panel assembly.

Display panel assemblies are, of course, very well known to the prior art. The display panel assembly over which this display panel assembly constitutes an improvement is that display panel assembly illustrated in Bubb U.S. Pat. No. 3,537,200, issued Nov. 3, 1970. The display panel assembly illustrated in the Bubb U.S. Pat. No. 3,537,200 is comprised of a bottom rectangular display panel and a top rectangular display panel, the panels being connected one with the other by connector strips at adjacent corners thereof when the top edge of the bottom panel and the bottom edge of the top panel are located in spaced parallel relation one with the other, all as illustrated in FIG. 1 of that patent. The entire display panel assembly is supported on feet connected at one end to connector strips inserted into opposed corners at the bottom edge of the bottom display panel, also as illustrated in FIG. 1 of that patent. The Bubb U.S. Pat. No. 3,537,200 display panel assembly structure is a three-dimensional display panel assembly in that it presents length and height by virtue of its advertising message face walls, as well as depth by virtue of its narrow side walls.

Each of the display panels illustrated in the Bubb U.S. Pat. No. 3,537,200 is in the erect or use attitude as manufactured, and remains in that same attitude throughout its useful life. In other words, each of the display panels illustrated in the Bubb U.S. Pat. No. 3,537,200 cannot be collapsed, i.e. cannot be transported or stored flat. This for the reason that the Bubb U.S. Pat. No. 3,537,200 display panels are provided with a foamed thermoplastic core which so maintains those panels in the erect attitude, i.e., in the three-dimensional attitude. The foamed thermoplastic core provided in each of the display panels provides two problems of significance from a practical commercial standpoint. First, the foamed thermoplastic material itself is not an inexpensive component of the display panel assembly, particularly when the individual display panels are of substantial length and height. Second, and since the foamed thermoplastic interior core is provided at the point of manufacture, the display panels of each display panel assembly must be shipped or transported to the point of end use in the erect state. This, of course, means that substantially greater volume is required to transport the individual display panels than would be the case if the display panels could fold flat. This second problem also occurs in storage of the display panels when those panels are not in use.

It has been one objective of this invention to provide an improved display panel assembly having a hollow three-dimensional display panel movable between a substantially flat storage attitude and an erect display attitude, that display panel when erect being connectable with an adjacent erect display panel of the same basic structure, or with feet for supporting the erect display panel in a use position, by special connector strips structured to interfit with the hollow display panel itself.

It has been another objective of this invention to provide an improved display panel assembly having a hollow three-dimensional display panel movable between a substantially flat storage attitude and an erect display attitude, that display panel incorporating at least one tubular support member for retaining the panel in the erect attitude, the support member being structured to receive one end of a connector in a passageway at least partially defined by that support member, the other end of the connector strip being receivable in an adjacent display panel to connect the two display panels or being connected to a foot for supporting the one display panel.

In accord with these objectives, the improved display panel assembly of this invention comprises a hollow three-dimensional display panel movable between a substantially flat transport attitude and an erect display attitude. A tubular support member extends along and is adjacent to one edge of the display panel, the tubular support member supporting the display panel in the erect attitude when that member is erected and permitting the display panel to collapse into the storage attitude when that member is collapsed. Slot and tab structure partially carried by the tubular support member and partially carried by a face wall of the display panel retains the tubular support member and, hence, the display panel itself, in the erect attitude. The hollow tubular member is structured so that, when the display panel is erected, the tubular member at least partially defines a passageway adapted to receive one end of a connector strip in supportive relation therein. The other end of the connector strip may be provided with a foot by which the display panel can be supported on a surface, or may be provided with another end portion, analogous to the one end, which permits the display panel to be connected with a similarly structured second display panel.

Other objectives and advantages of this invention will be more apparent from the following detailed description taken in conjunction with the drawings in which:

FIG. 1 is a perspective view illustrating a display panel assembly shown in the erect or use attitude, the assembly having two display panels each of which is structured in accord with the principles of this invention, FIG. 2 is a perspective view similar to FIG. 1 but illustrating the two display panels separated one from another, and connector strips in accord with the principles of this invention removed from interengagement with the display panels, all for purposes of clarity;

Figure 1:
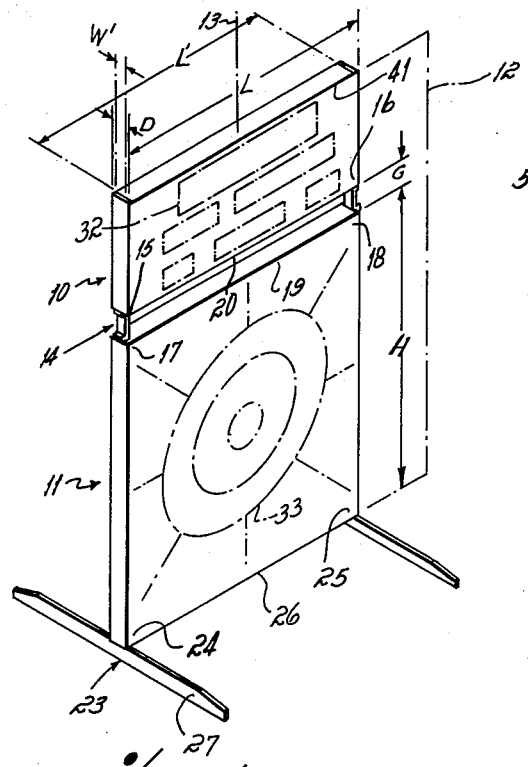
Figure 2:
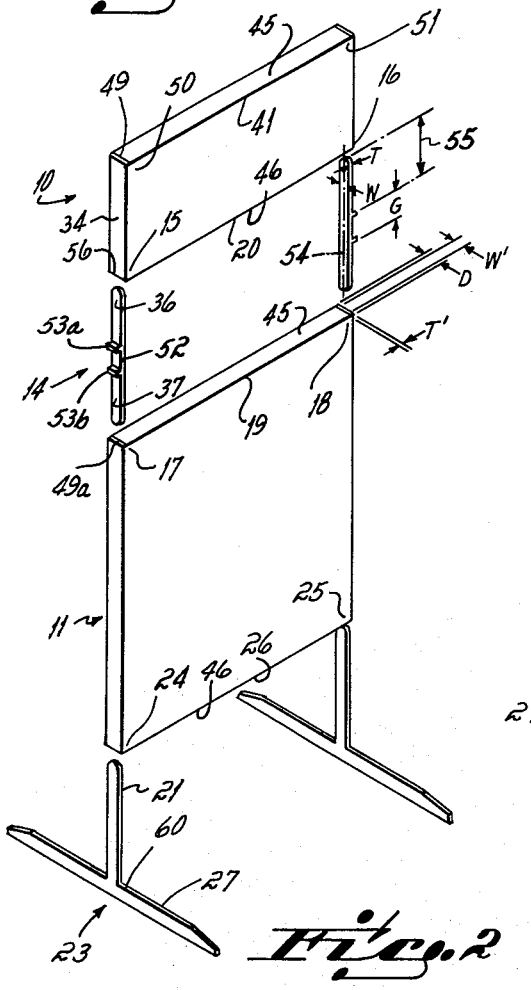
Figure 3:
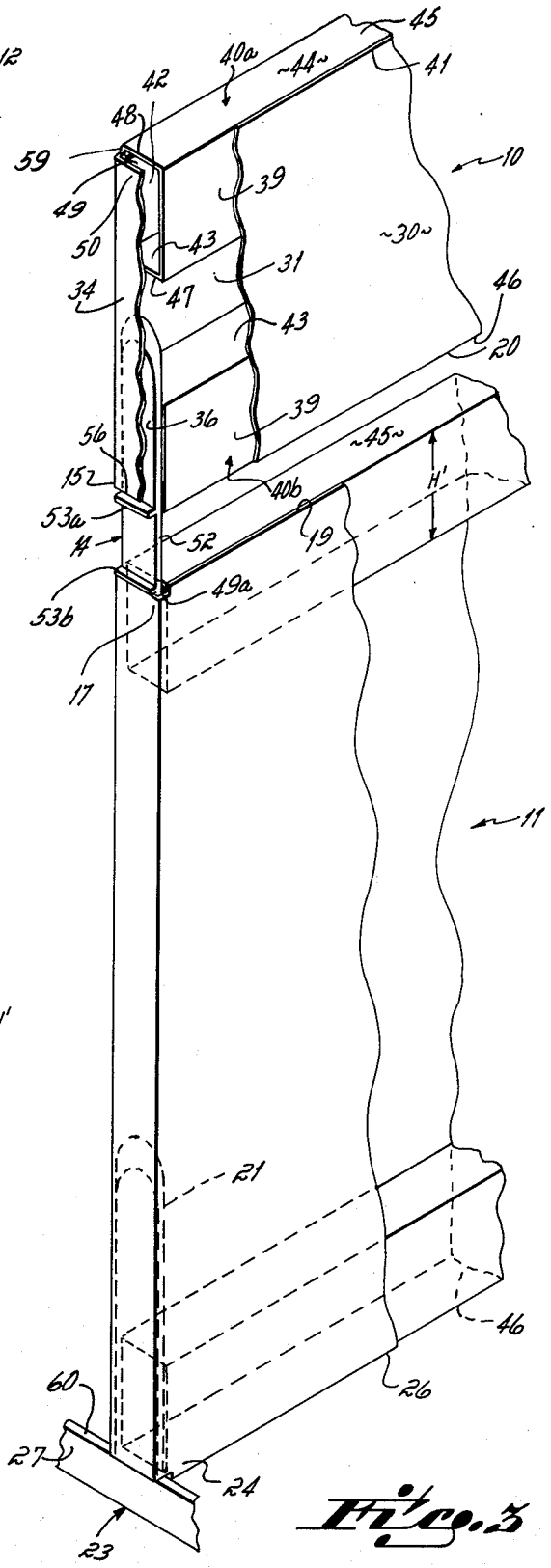
FIG. 3 is a broken away perspective view of the left hand half of the display panel assembly illustrated in FIG. 1, same showing the connector strips in cooperative interengagement with the display panels.

The improved display panel assembly of this invention is particularly illustrated in FIGS. 1–3. The structural embodiment of the improved display panel assembly shown includes a top display panel 10 and a bottom display panel 11. The display panels 10, 11 are both of rectangular configuration, are connected together in a common display plane 12, and are connected together in symmetrical fashion relative to a vertical longitudinal display axis 13, by connector strips 14 at adjacent corners 15, 17 and 16, 18 on the top and bottom display panels, respectively. That is, the connector strips 14 connect adjacent panel corners 15, 17 and 16, 18 at the upper edge 19 of the bottom display panel 11 and at the lower edge 20 of the top display panel 10, those edges being disposed parallel one to the other. The connector strips 14 are structured, as described in detail below, to connect the top 10 and bottom 11 display panels one with the other, as well as to maintain those display panels in spaced relation relative one to the other, i.e., to establish gap G between the two display panels. The two display panels 10, 11 are maintained in a generally vertical or upright display attitude by legs 23 connected to the bottom display panel 11 through connector strips 21, also described in detail below, at opposed bottom corners 24, 25 on the bottom edge 26 of that bottom display panel. Foot 27 of each leg 23 is disposed normal to the plane 12 of the display panels 10, 11 when interconnected with the bottom display panel 11 so as to provide support for the display panel assembly when used on a horizontal surface such as a table or countertop, not shown.

More particularly, and with reference to FIGS. 2 and 3, note that each display panel 10, 11 includes two planar display face walls, i.e., a front face wall 30 and a rear face wall 31, disposed parallel one to the other. The front display face wall 30 may carry an advertising message 32 or 33 on the exterior side thereof, or both the front and the rear display face walls may carry an advertising message, as desired by the user. The display face walls 30, 31 of each display panel 10, 11 are connected by side walls 34, 35 thereby providing each display panel with a three-dimensional effect when erect, i.e., each of the display panels thereby having a length L, a height H, and a depth D. Note particularly that the display panels 10, 11 are hollow.

Each of the rectangular display panels 10, 11 is further provided with a tubular support member 40 along at least one of the top 41, 19 and bottom 20, 26 edges thereof. In the embodiment illustrated in this application, both display panels 10, 11 are each provided with two such tubular support members, one 40*a* along the top edge 41, 19 of each display panel, and one 40*b* along the bottom edge 20, 26 of each display panel. Note particularly that the tubular support members 40 are hollow. Each of the tubular support members 40 is comprised of opposed face walls 39, 42 that lie adjacent to the display face walls 30, 31 of the display panel 10 or 11. Each tubular support member 40 also is comprised of an inner edge wall 43, those inner edge walls facing toward one another when the display panel 10, 11 is erected as illustrated in FIGS. 2 and 3. Also, each of the tubular support members 40 includes an outer edge wall 44, which outer edge walls face away from one another when the display panel 10, 11 is erected. The outer edge walls 44 of the top 40*a* and bottom 40*b* tubular support members also constitute respectively, the top 45 and bottom 46 walls of the display panel 10, 11 when the display panel assembly is erected as illustrated in FIGS. 2 and 3. It is by virtue of the tubular support members 40 that support or rigidity is provided for the opposing display face walls 30, 31 of each panel 10, 11 when that display panel is in the erect attitude, thereby supporting same in the erect three-dimensional attitude without need for a foam thermoplastic core as is illustrated in the Bubb U.S. Pat. No. 3,537,200. It is also by means of the tubular support members 40, and as is more particularly described in detail below, that each display panel 10, 11 can be folded flat for storage or transport purposes, the connector strips 14, 21, of course, being disconnected or withdrawn from the display panel when same is so folded flat, the folded flat attitude being particularly illustrated in FIG. 7.

Figure 4:
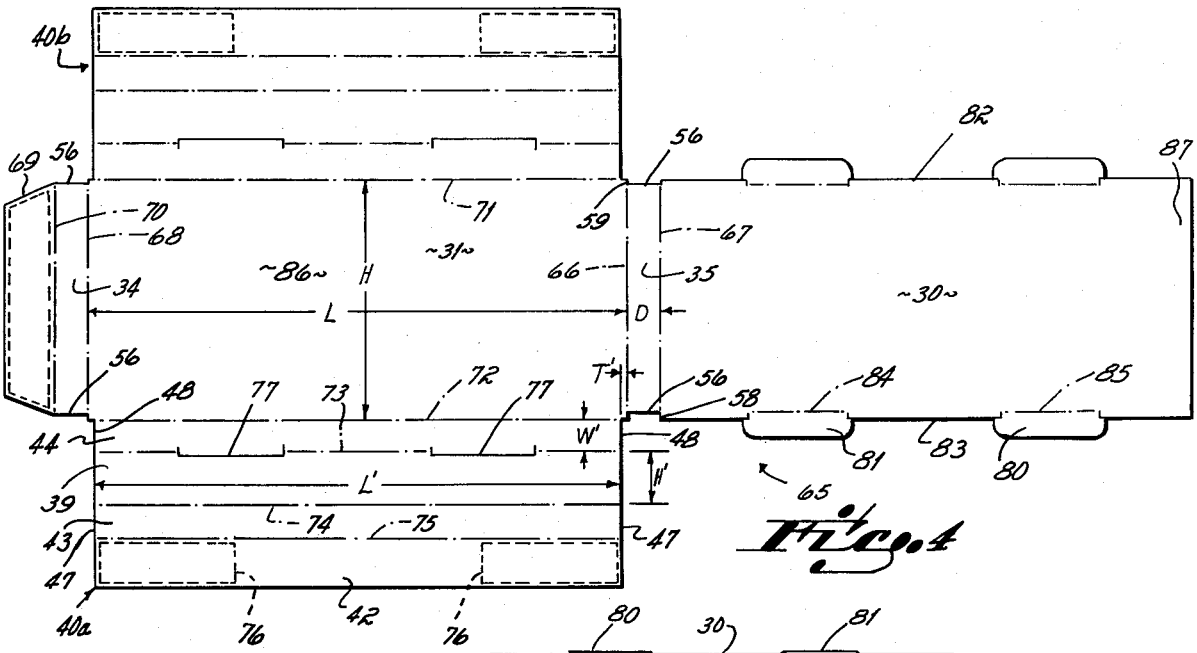
FIG. 4 is a top view of a cardboard blank illustrating a blank from which the top display panel shown in FIG. 1 may be fabricated.

Note particularly that the length L' of the face 39, 42 and edge 43, 44 walls of each tubular member 40*a*, 40*b* is slightly less than the length L of the display face walls 30, 31, i.e., of the display panel itself, see FIGS. 1 and 4. Thus, end edges 47, 48 defined by inner 43 and outer 44 edge walls of the tubular support members 40 stop short of the adjacent side wall 34 of the display panel 10, 11 when the display panel is in the erect attitude, see particularly FIG. 3. This structure of the tubular support members 40, in combination with the adjacent side wall 34 of the display panel 10, 11, defines a passageway 49 adjacent to the display panel's side walls 34 at each corner thereof, i.e., at corners 15, 16, 50, 51 for the top panel 10 and at corners 17, 18, 24, 25 for the bottom panel 11. Each passageway 49 is, therefore, particularly defined by side wall 34 of a display panel 10, 11 on one side, by edge wall end edges 47, 48 of the adjacent tubular support member 40*a* or 40*b* on the opposide side, and by front 30 and rear 31 face walls of the display panel 10, 11 on the other two sides so as to provide a substantially rectangular or tubular passageway in cross section, that passageway being particularly configured and structured to receive connector strip 14 in supportive relation. Each passageway 49 is parallel to the side walls 34 and, therefore, parallel to the longitudinal axis 13 of the display panel assembly, and each passageway is in the plane 12 of the display panel.

The connector strips 14, 21 with which the display panels of this invention are adapted for use are rigid, and are particularly illustrated in FIG. 2. The connector strips 14 are adapted to interconnect the top display panel 10 and the bottom display panel 11 one with another. Each connector strip 14 is of generally the same cross sectional configuration and cross-sectional dimensions as that of the passageway with which it is adapted for use. Each strip 14 is provided with a top tongue portion 36 and a lower tongue portion 37, those tongue portions extending in opposite directions from a center section 52. The center section 52 is defined by spaced ribs 53 that extend normal to the longitudinal axis 54 of the connector strip 14. The length of the center section 52 is equal to the gap G desired between the top 10 and bottom 11 display panels when same are assembled as illustrated in FIGS. 1 and 3. The length 55 of each of the top 36 and bottom 37 tongue portions on the connector strip 14 is preferably greater than the length of passageway 49, i.e., greater than the height H' of the face walls 41, 42 of the tubular members 40. Also, the thickness T of each tongue 36, 37 portion is preferably about the same as but no greater than the thickness T' of passageway 49, and the width W of each tongue 36, 37 portion is preferably about the same as but no greater than the width W' of passageway 49. Thus, and as is particularly illustrated in FIGS. 2 and 3, when a connector strip's tongue portion 36 is slid longitudinally into passageway 49 at either bottom corner 15, 16 of top display panel 10, that tongue portion is restrained therein by end edges 47, 48 of the tubular support member 40*b* in cooperation with side wall 34 of that top display panel 10, and is located relative thereto by end edge 56 of the top display panel's side wall 34 seating against rib 53*a*. In like manner, the connector strip's bottom tongue portion 37 is slid longitudinally into passageway 49*a* in the adjacent corner 17 or 18 of the bottom display panel 11, thereby seating that tongue portion 37, as located by rib 53*b*, within the bottom display panel 11. With the connector strips 14 in position at adjacent corners 15, 17 and 16, 18 of the top 10 and bottom 11 display panels, it will be apparent that the display panels are thereby interconnected, and are maintained in spaced relation one with the other.

A connector strip 21 as previously mentioned, is also formed integral with each foot 27 to provide a leg 23 at each corner 24, 25 of the bottom display panel. Each connector strip 21, which is formed integral with a foot 23, serves to connect the bottom display panel 11 with a foot in much the same manner as the two display panels 10, 11 are connected one with the other by connector strips 14 previously described. The connector strip 21 (which is of the same thickness T, and width W characteristics, but of slightly greater length, than the connector strips 14) cooperates with identical passageways 49 defined by the edges 47, 48 or inner 43 and outer 44 edge walls of the tubular support member 40*b* along the bottom edge 26 of the bottom display panel 11. In other words, the connector strip 21 portion of leg 23 is of a length greater than the height H' of the tubular support's face walls 39, 42. This permits the bottom edges 58, 59 of the display face walls 30, 31 to seat or rest on the top rib or edge 60 of each foot 23, thereby retaining or locating each connector strip 21, i.e., each leg 23, in operational relation with its respective bottom corner 24 or 25 of the bottom display panel 11. Thus, the bottom display panel 11 is supported or maintained above the surface of a table or countertop, not shown, by virtue of that panel being seated on top rib or edges 60 of the feet 23 as illustrated in FIG. 1.

The blank 65 from which the top display panel 10 is fabricated is illustrated in FIG. 4, it being understood that the blank, not shown, from which the bottom display panel 11 is fabricated will be of the same general structure and configuration except for dimensions. The blank 65 is cut out of a single piece of cardboard, thereby fabricating a display panel 10 where all walls are integral with at least one other adjacent wall as separated only by score lines. The blank 65 for display panel 10 comprises a front face wall 30 panel and a rear face wall 31 panel connected together by one side wall 35 panel along vertical score lines 66, 67. The rear face wall 31 panel is also provided with the other side wall 34 panel, the other side wall 34 panel being separated from the display face wall panel by score line 68. A glue flap 69 is connected to the other side wall 34 panel, and separated therefrom by score line 70.

Top 41 and bottom 20 edges of the top display panel 10, as defined by score lines 71, 72, respectively, of that face wall 31 panel carrying both side wall 34, 35 panels, each connect the face wall 31 panel with a series of panels 44, 39, 43, 42 extending outwardly therefrom, the tubular support members 40*a*, 40*b* along the top 41 and bottom 20 edges of that display panel 10 being formed from those panels 39 and 42–44, also see FIG. 4. Each tubular support member 40 is comprised of an outer or exposed edge wall 44 panel connected to the adjacent display face wall 31 panel on score line 71 or 72, a face wall 39 panel connected thereto on score line 73, an inner edge wall 43 panel connected to the face wall 39 panel on score line 74, and a glue face wall 42 panel connected to the inner edge wall 43 panel on score line 75. The glue face wall 42 panel is provided with glue areas 76 on the underside thereof.

Two slots or notches, spaced along each score line 73 one from the other, are cut out on that score line 73 as defined by cut lines 77, see FIG. 4. These cut lines 77 are adapted to define slots or openings 78, 79 in tubular support members 40*a*, 40*b* when the display panel is in the erect or use attitude, see FIG. 6. Tabs 80, 81 are fixed in mirror relation locations on the top 82 and bottom 83 edges of the other display face wall 30 panel relative to slots 78, 79 on the tubular support member wall 39 and 42–44 panels for tubular support members 40*a* and 40*b*. In other words, and as illustrated in FIG. 4, the other display face wall 30 panel (i.e., that panel not provided with the tubular support member wall panels 39 and 42–44 along the top 71 and bottom 72 edges thereof) is provided with locking tabs 80, 81 on the top 82 and bottom 83 edges thereof, the locking tabs being foldable relative to that face panel on score lines 84, 85. The locking tabs 80, 81 cooperate with slots 78, 79 in the tubular support members 40*a*, 40*b* to restrain the fully fabricated display panel 10 in the erect attitude as explained in greater detail below.

Figure 5:
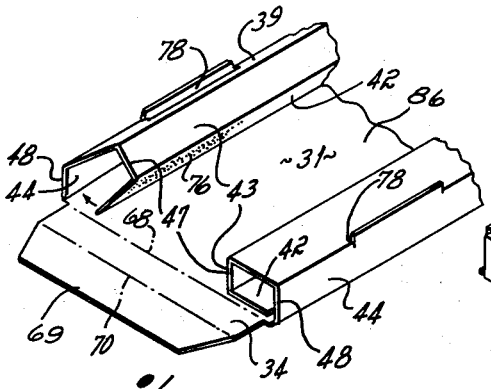
FIG. 5 is a perspective view illustrating initial steps in fabricating the top display panel from the blank illustrated in FIG. 4.
Figure 6:
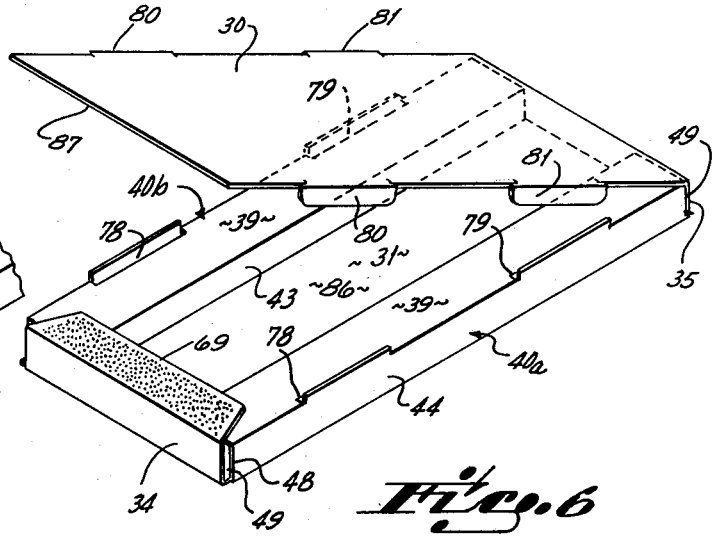
FIG. 6 is a perspective view illustrating latter steps in producing the top display panel from the blank illustrated in FIG. 4.

Assembly of fabrication of the blank 65 for the display panel 10 is illustrated in FIGS. 5 and 6. As shown in FIG. 5, and as initial steps from the flat or as-cut attitude of the blank 65 illustrated in FIG. 4, each set of the tubular support member wall 39 and 42–44 panels is rolled or folded over toward the other onto the inside face 86 of the display face wall 31. In such a folded attitude, glue spots 76 on the face wall 42 panels of each tubular support member 40 are placed flush against the inside face 86 of the display face wall 31, thereby gluing the tubular support member wall 39 and 42–44 panels into rectangular and tubular cross-sectional configuration as illustrated in FIG. 5. Note particularly, therefore, that each tubular support member 40*a*, 40*b* is only glued to one display face wall 31 of the display panel 10, i.e., and as described hereinafter, the other display face wall 30 of the display panel 10 is not glued to the tubular support members 40*a*, 40*b*.

Figure 7:
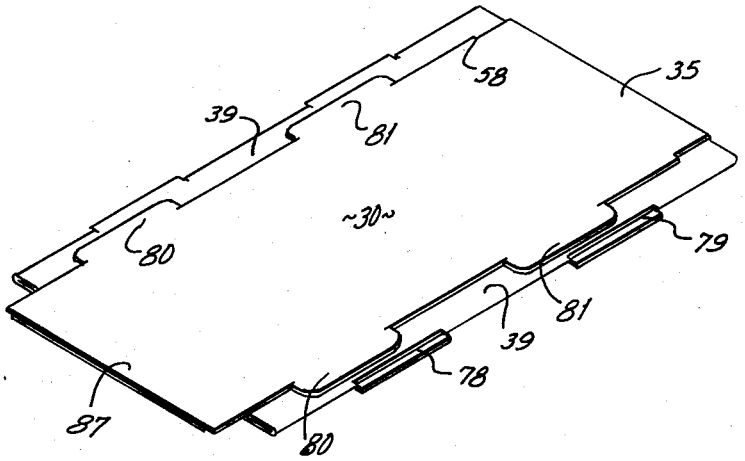
FIG. 7 is a view of the top display panel in fully collapsed or storage attitude.

Once the tubular support members 40*a*, 40*b* have been formed on the inside face 86 of the display face wall 31 as illustrated in FIG. 5, the side wall 34 panel is folded up with the glue flap 69 attached thereto folded inwardly of the display panel 10 periphery as illustrated in FIG. 6. Thereafter, the other display face wall 30 is folded up on score lines 66, 67, and is glued to the glue flap 69 on its side edge 87 area, thereby establishing the three-dimensional or box-like configuration of the display panel 10. Note particularly that the glue flap 69 attached to the side wall 34 panel is not glued to the tubular support members 40*a*, 40*b*, i.e., is only glued to the other display face wall 30. Thus, the other display face wall 30 is not glued at all to the tubular support members 40*a*, 40*b* and this permits the entire display panel 10 to collapse since the face walls 39 of the tubular support members 40*a*, 40*b* are free to slide relative to the other display face wall 30. In other words, the tubular support members 40*a*, 40*b* are able to collapse since nothing prevents them from pivoting on score lines 72–75, and the side walls 34, 35 of the display panel simply collapse since nothing prevents them from pivoting on score lines 66–68, 70, thereby permitting the entire display panel 10 to be folded flat for storage or transport purposes as illustrated in FIG. 7. This has the advantages discussed earlier in this specification, and particularly permits elimination of the thermoplastic foamed core as required in the Bubb U.S. Pat. No. 3,537,200.

When erection of the fully fabricated but folded flat display panel 10 of FIG. 7 is desired into a use attitude, as illustrated in FIGS. 1–3, the display panel 10 is simply erected by pivoting the walls on the score lines, and tabs 80, 81 folded normal to the face wall panels 30, 31. The tabs 80, 81 are then inserted into slots 78, 79 defined in score lines 73 of the tubular support members 40*a*, 40*b* as illustrated in FIG. 6. The tabs 80, 81, in combination with the slots 78, 79, prevent the display panel 10 from folding or collapsing into the FIG. 7 attitude, thereby maintaining same in the erected or use attitude illustrated in FIG. 2. As previously mentioned, and in the erect or use attitude, the tubular support members 40*a*, 40*b* provide the rigidity required to maintain the display panel in a three-dimensional or erect configuration. Further, the tubular support members 40 also cooperate in defining passageways 49 at each corner 15, 16, 50, 51 of the display lanel 10 which are adapted to receive connector strips 14 or 21 so as to connect two display panels 10, 11 one with another, or so as to provide feet 23 by which the display panel assembly can be maintained erect, all as earlier described.

Having described in detail the preferred embodiment of my invention, what I desire to claim and protect by Letters Patent is:

1. An improved display panel assembly comprising (a) a hollow three-dimensional display panel comprising a front display face wall, a rear display face wall, and two side walls connected between said display face walls, a support member extending along and adjacent to each of the top and bottom edges of said display panel, at least one of said support members being tubular and having two spaced apart edge walls that each define at least one end edge, said two end edges thereby being spaced apart one from the other, said support members being erectable from a storage position where said face walls are collapsed one on top of the other to a use position where said face walls are spaced one from the other a distance generally equal to the width of said edge walls, and one side wall and said two end edges of said tubular member's edge walls cooperating to define a passageway for carrying a connector strip along the inside face of said side wall when said tubular support member is erected, and slot and tab structure partially carried by said tubular support member and partially carried by a face wall of said display panel, said slot and tab structure cooperating to maintain said display panel in a three-dimensional erect attitude when said slot and tab structure is engaged and to permit said display panel to collapse into a storage attitude when said slot and tab strucure is disengaged, and (b) a connector strip having a rigid tongue portion at one end thereof, said tongue portion having a cross-sectional configuration the same as the cross-sectional configuration of said passageway, said tongue portion being of cross-sectional dimensions substantially equal to but no greater than the cross-sectional dimensions of said display panel passageway, and said tongue portion being of a length greater than the length of said display panel passageway, the dimensions and cross-sectional configuration of said connector strip and said passageway, including said end edges of said tubular support member, cooperating to retain said connector strip in lateral position with said passageway.

2. An improved display panel assembly as set forth in claim 1, said connector strip comprising a rib on said connector strip, said rib being adapted to seat against said display panel for defining the insertion limit of said connector strip into said passageway.

3. An improved display panel assembly as set forth in claim 1, the other end of said connector strip being provided with one of a foot by which said display panel can be supported on a surface and an end analogous to said one end which permits said display panel to be connected with a second similarly structured display panel.

4. An improved display panel assembly as set forth in claim 1, said passageway being provided at a corner of said display panel.

5. An improved display panel assembly as set forth in claim 4, a passageway being provided at two corners of said display panel, said tubular support member extending between said two corners.

6. An improved display panel assembly as set forth in claim 5 said display being fabricated from a single blank.

7. An improved display panel assembly as set forth in claim 6, said display panel blank comprising a first face wall panel and a second face wall panel, said face wall panels being foldable relative one to the other on a score line, and a series of tubular support member panels separated one from the other by score lines, said series being connected to one edge of one of said display face walls on a score line.

8. An improved display panel assembly as set forth in claim 7, said display panel blank further comprising two series of tubular support member panels, the other of said series being connected to another edge of the same one of said display face walls as said first series is connected, the outermost panel of each series being glued to the inside wall of the display face wall to which same is connected upon fabrication of said display panel.

* * * * *